United States Patent [19]

Auer

[11] Patent Number: 4,850,931

[45] Date of Patent: Jul. 25, 1989

[54] SPIN-OUT TOY VEHICLE

[75] Inventor: Robert T. Auer, East Stroudsburg, Pa.

[73] Assignee: Buddy L Corporation, New York, N.Y.

[21] Appl. No.: 240,711

[22] Filed: Sep. 6, 1988

[51] Int. Cl.[4] ..... A63H 17/00; A63H 29/24; B60D 1/12

[52] U.S. Cl. ..... 446/437; 446/461; 446/463; 180/271

[58] Field of Search ..... 446/437, 436, 435, 431, 446/430, 429, 441, 444, 445, 461, 462, 463, 23; 180/271

[56] References Cited

U.S. PATENT DOCUMENTS

| | | | |
|---|---|---|---|
| 2,070,465 | 2/1937 | Carl | 446/436 |
| 4,556,396 | 12/1985 | Kennedy et al. | 446/462 X |
| 4,556,397 | 12/1985 | Arad et al. | 446/437 X |
| 4,571,212 | 2/1986 | Kakizaki | 446/462 |
| 4,631,041 | 12/1986 | Chang et al. | 446/462 X |
| 4,680,021 | 7/1987 | Maxim | 446/437 X |
| 4,702,720 | 10/1987 | Konta et al. | 446/437 X |

FOREIGN PATENT DOCUMENTS

| | | | |
|---|---|---|---|
| 1012940 | 7/1952 | France | 446/437 |
| 287398 | 3/1926 | United Kingdom | 446/461 |

*Primary Examiner*—Robert A. Hafer
*Assistant Examiner*—D. Neal Muir
*Attorney, Agent, or Firm*—Michael Ebert

[57] ABSTRACT

A toy vehicle in which a flywheel motor assembly is operatively coupled to one set of wheels such that when the motor is revved up and the vehicle is released, it then advances on the ground in the forward direction. A settable distance counter assembly is operatively coupled to the other set of wheels to count the number of feet or other increment of distance travelled by the vehicle. Also included is a braking mechanism provided with a normally-retracted brake shoe whose position is off center with respect to the longitudinal axis of the vehicle and a normally-retracted brake clutch adapted to engage a braking wheel in the flywheel motor assembly. The braking mechanism is responsive to the distance counter such that when a pre-set distance is travelled by the vehicle, the brake shoe is projected below the chassis to engage the ground and the brake clutch is then caused to engage the braking wheel to arrest the motor. As a consequence, the braked vehicle is caused to swerve from the forward direction, to skid and to spin out.

7 Claims, 5 Drawing Sheets

Fig. 4.
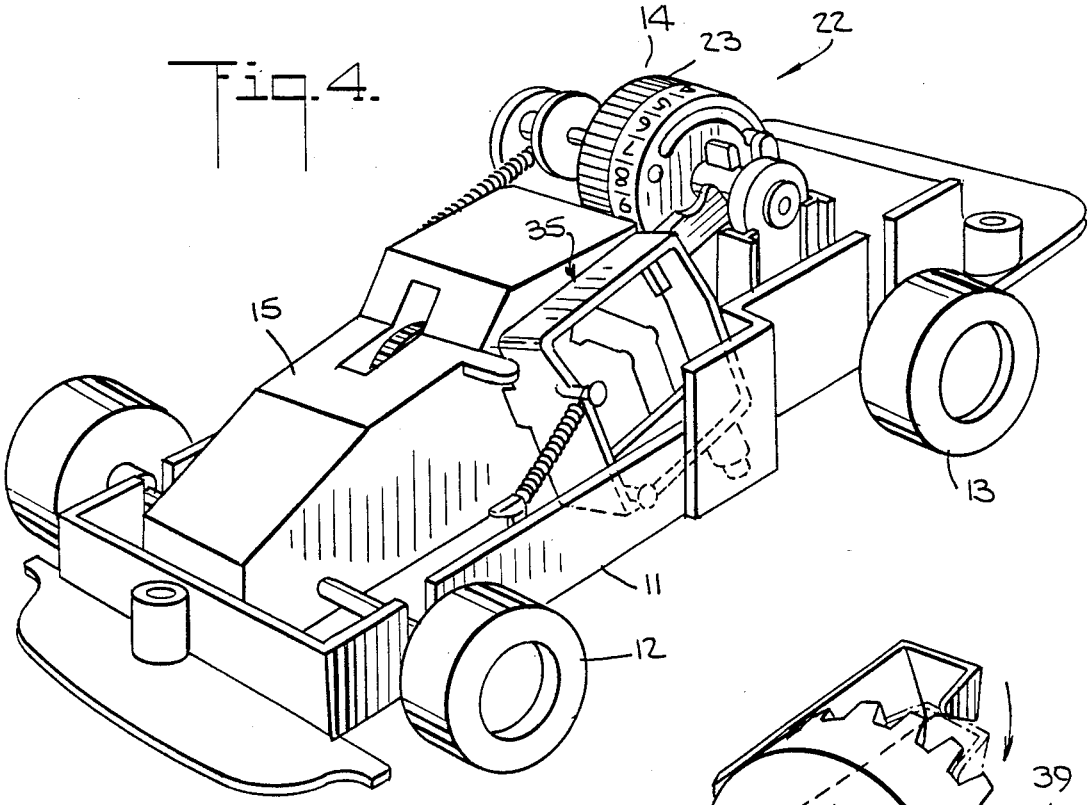
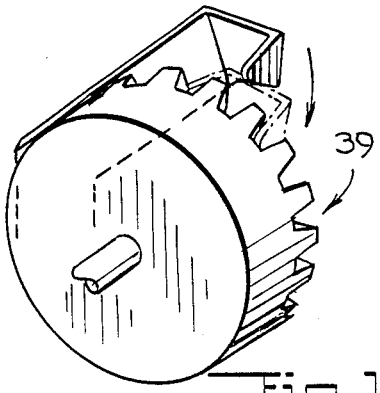
Fig. 11.
Fig. 10.
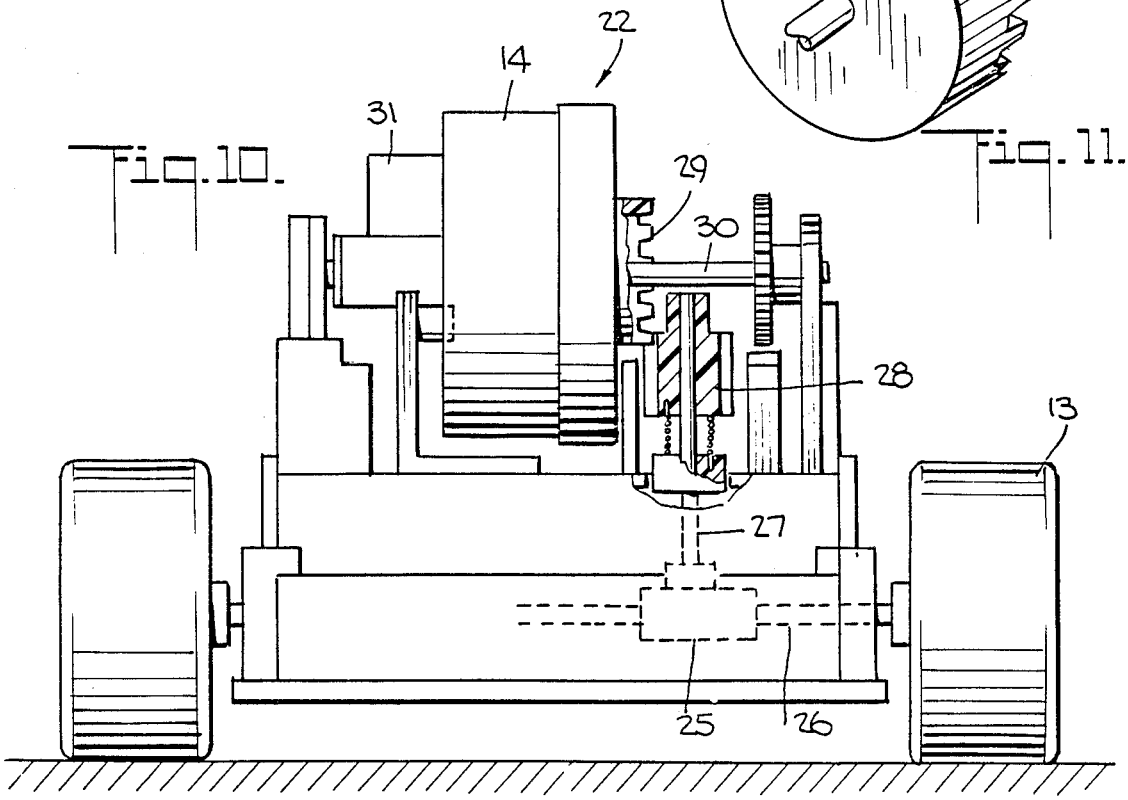

Fig. 8.
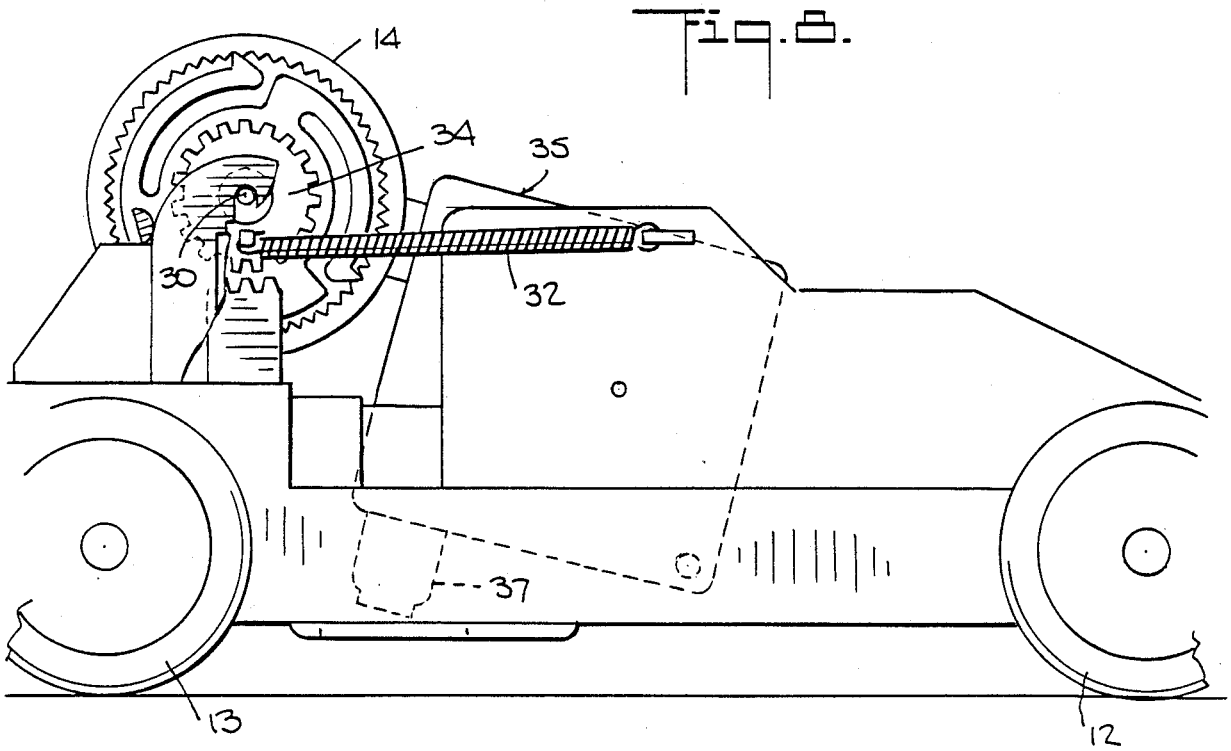
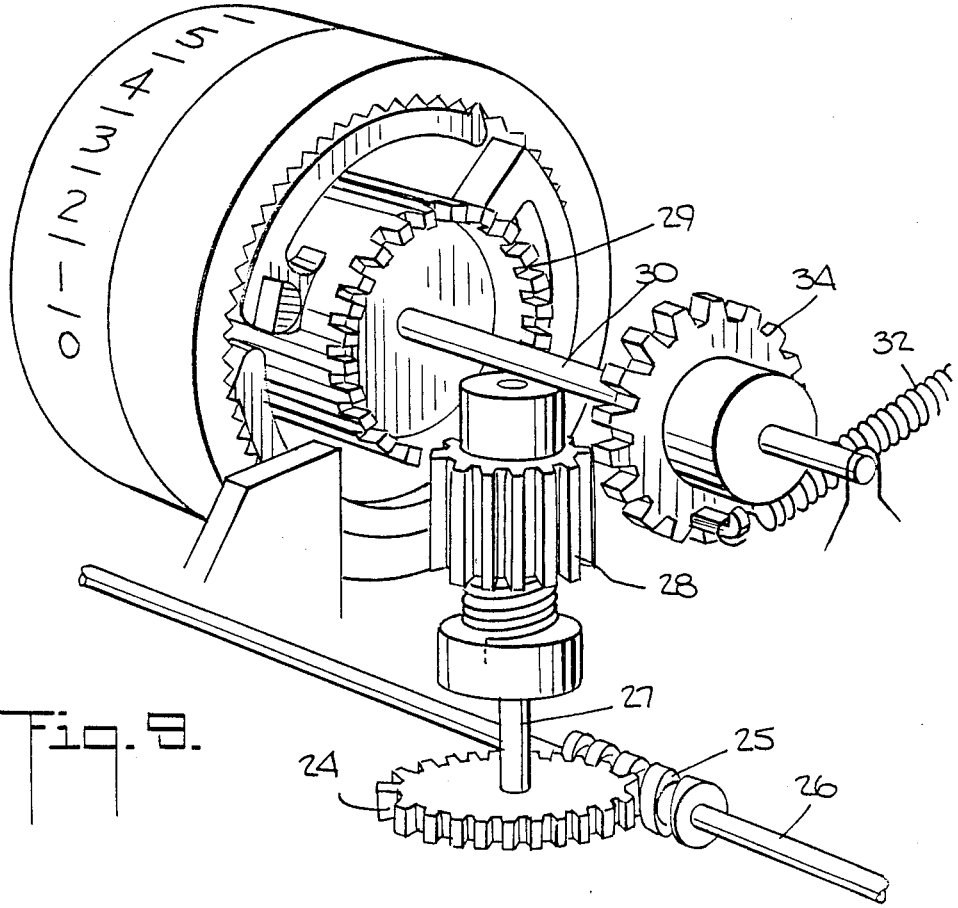
Fig. 9.

SPIN-OUT TOY VEHICLE

BACKGROUND OF INVENTION

1. Field of Invention

This invention relates generally to toy vehicles having a flywheel motor which when revved up causes the vehicle to travel in the forward direction, and more particularly to a vehicle of this type which when the vehicle travels a predetermined distance, is caused to swerve from the forward direction, to skid and to spin out.

2. Status of Prior Art

Toy vehicles are known which employ as the motor therefor an energy-storing flywheel coupled to one set of wheels. In order to rev up the flywheel, the player holds the car and pushes it along the ground until the flywheel has acquired sufficient momentum to drive the vehicle in the forward direction for a fair distance along the ground or a playing surface, after which the vehicle is released and permitted to travel.

In play, children usually seek as best they can to initiate an observed adult activity. Play, therefore, represents a learning experience that prepares the child for the adult world. Thus, a child who plays with a toy combat weapon prefers a toy whose appearance resembles that of an actual weapon, and a child who plays with toy cars or trucks is happiest with those that behave and look like vehicles of the type he has seen driven by adults.

A not uncommon experience encountered with actual vehicles is spin-out. This may occur when a driver runs over an oil slick or ice on the road, causing those wheels which engage the slippery surface to lose traction, as a result of which the vehicle veers from its travel direction. Should the driver, in seeking to cope with this unexpected condition then suddenly apply his brakes, this may accentuate the problem and cause the vehicle to skid and to spin-out.

In order to create spin-out and other stunt effects in a toy vehicle, the Kennedy et al. U.S. Pat. No. 4,556,396 discloses a toy vehicle provided with a flywheel motor having gyro-like characteristics. By launching the vehicle from a ramp at an inclination to the floor or playing surface, the forward launching thrust combined with the gyro action gives rise to spin-outs. However, a vehicle of this type when simply propelled along a flat playing surface without first being launched from a platform is incapable of producing spin-outs.

SUMMARY OF INVENTION

In view of the foregoing, the main object of this invention is to provide a toy vehicle having a flywheel motor which is capable of producing a spin-out after it has travelled a predetermined distance in the forward direction on a playing surface.

More particularly, an object of this invention is to provide a vehicle of the above type which is settable by the player to produce a spin-out after it has travelled a pre-set distance.

Also an object of this invention is to provide a toy vehicle of the above type which is efficient and reliable in operation and can be constructed at relatively low cost.

Briefly stated, these objects are attained in a toy vehicle in which a flywheel motor assembly is operatively coupled to one set of wheels such that when the motor is revved up and the vehicle is released, it then advances on the ground in the forward direction. A settable distance counter assembly is operatively coupled to the other set of wheels to count the number of feet or other increment of distance travelled by the vehicle. Also included is a braking mechanism provided with a normally-retracted brake shoe whose position is off center with respect to the longitudinal axis of the vehicle and a normally-retracted brake clutch adapted to engage a braking wheel in the flywheel motor assembly. The braking mechanism is responsive to the distance counter such that when a pre-set distance is travelled by the vehicle, the brake shoe is projected below the chassis to engage the ground and the brake clutch is then caused to engage the braking wheel to arrest the motor. As a consequence, the braked vehicle is caused to swerve from the forward direction, to skid and to spin out.

BRIEF DESCRIPTION OF DRAWINGS

For a better understanding of the invention as well as other objects and further features thereof, reference is made to the following detailed description to be read in conjunction with the accompanying drawings, wherein:

FIG. 4 is a top view of the vehicle with its body removed to expose the flywheel motor assembly and the settable counter and brake assembly as well as the braking mechanism mounted on the chassis of the vehicle;

FIG. 8 is a side view of the distance counter assembly;

FIG. 9 is a perspective view of the distance counter assembly;

FIG. 10 is an end view of the distance counter assembly; and

FIG. 11 illustrates how the brake clutch of the braking mechanism engages the braking wheel of the motor assembly.

DESCRIPTION OF INVENTION

Figure 1:
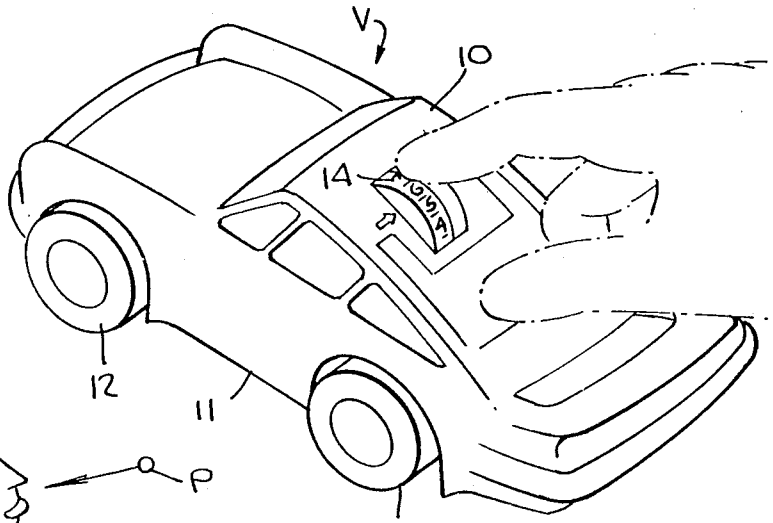
FIG. 1 is a perspective view of a toy spin-out vehicle in accordance with the invention.

The General Arrangement:

Referring now to FIG. 1, there is shown a spin-out toy vehicle V in accordance with the invention in the form of an automobile having a body 10 defining the windows, the hood, side doors and all other elements of the auto. Body 10 is supported on a chassis 11 provided with a set 12 of front wheels and a set 13 of rear wheels. While a streamline-styled toy automobile is shown, it is to be understood that in practice the vehicle may be in other vehicular forms, such as a bus or truck.

Projecting through an opening in the roof of the body is a graduated dial 14 that can be set by a player to a desired distance in terms of feet or any other increment of distance. Dial 14 is the adjustable element of a settable distance counter assembly mounted on chassis 11 and operatively coupled to the rear set 13 of wheels.

This assembly acts to count the number of feet travelled by the vehicle.

Also mounted on the chassis and operatively coupled to the front set 12 of wheels is a flywheel motor assembly which when revved up by the player by pushing the vehicle along the ground, will cause the vehicle, when released from the hand of the player, to travel in the forward direction until it reaches the pre-set distance, at which point the vehicle is automatically braked in a manner causing it to swerve from the forward path, to skid and to spin out.

This braking action is effected by a braking mechanism provided with a normally-retracted brake shoe whose position is off center with respect to the longitudinal axis of the vehicle, and a normally retracted brake clutch adapted to engage a braking wheel in the flywheel motor assembly.

Figure 2:
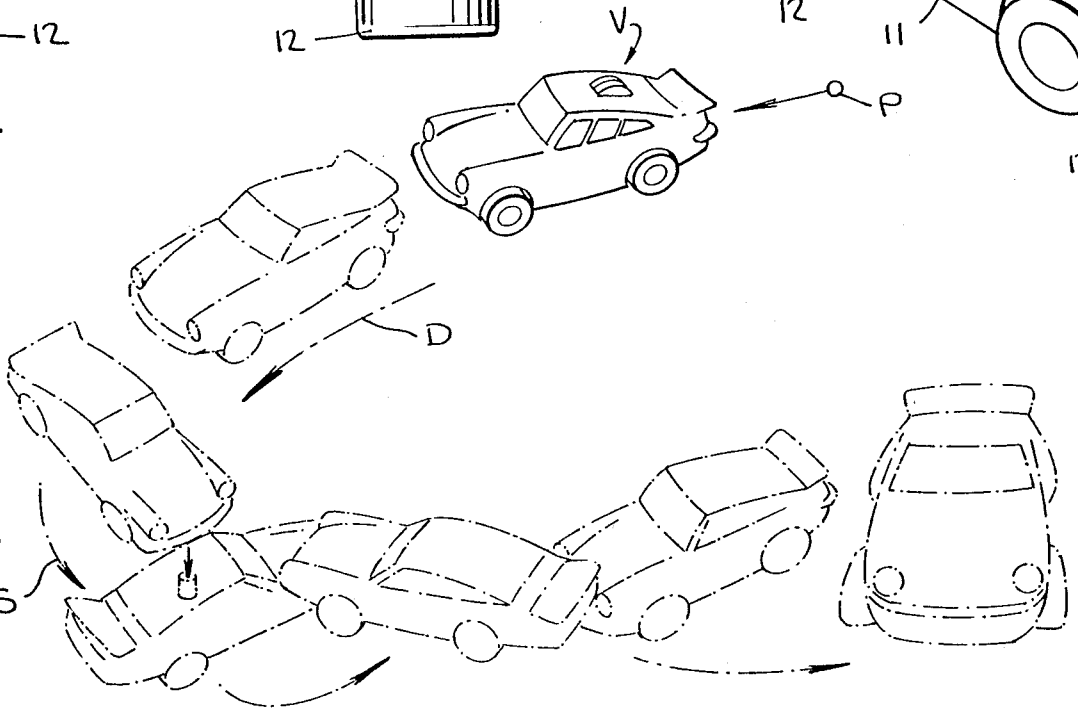
FIG. 2 illustrates the vehicle as it undergoes a spin-out action.

As shown in FIG. 2, vehicle V, when revved up and released travels from a starting point P in the forward direction D until it reaches a pre-set distance, say, 8 feet from its starting point. The braking mechanism which is responsive to the distance counter then causes the brake shoe to be projected below the chassis to frictionally engage the ground. The brake clutch is at the same time caused to engage the braking wheel to arrest the flywheel motor.

As a consequence, the braked vehicle is caused to swerve from the forward direction D along the curved path S. But because of the momentum acquired in forward movement, the braked vehicle then skids to spin out, as indicated by the successive positions of the vehicle as in FIG. 2, until the vehicle comes to a halt, thereby simulating a real life spin-out.

When the vehicle is then lifted from the ground for replay, the dial, which in the course of vehicle travel turns to an extent determined by the distance travelled, then automatically returns to its zero distance position, so that the player for the next round of play can set the dial to a new distance setting.

The above described actions are accomplished by means of a flywheel motor assembly, a settable distance counter assembly and a braking mechanism cooperating with these assemblies.

Figure 3:
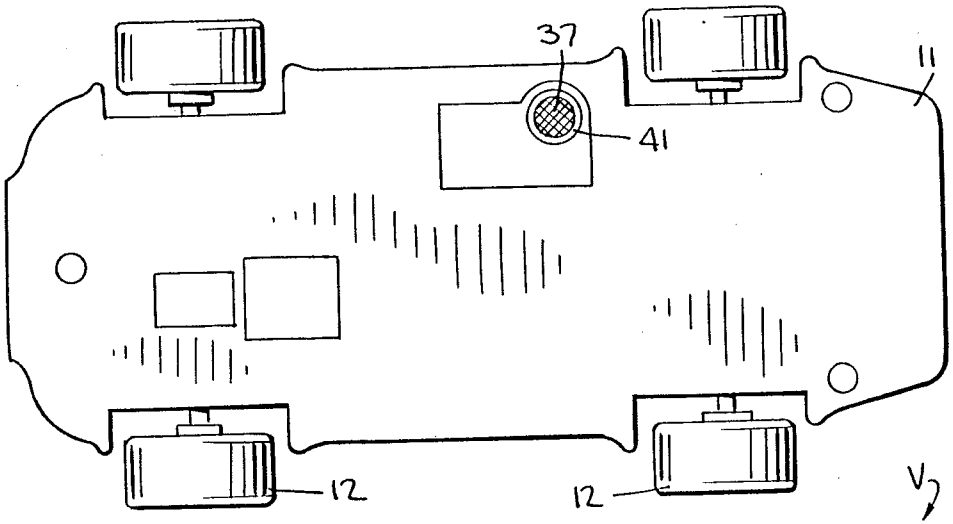
FIG. 3 is a bottom view of the vehicle.
Figure 5:
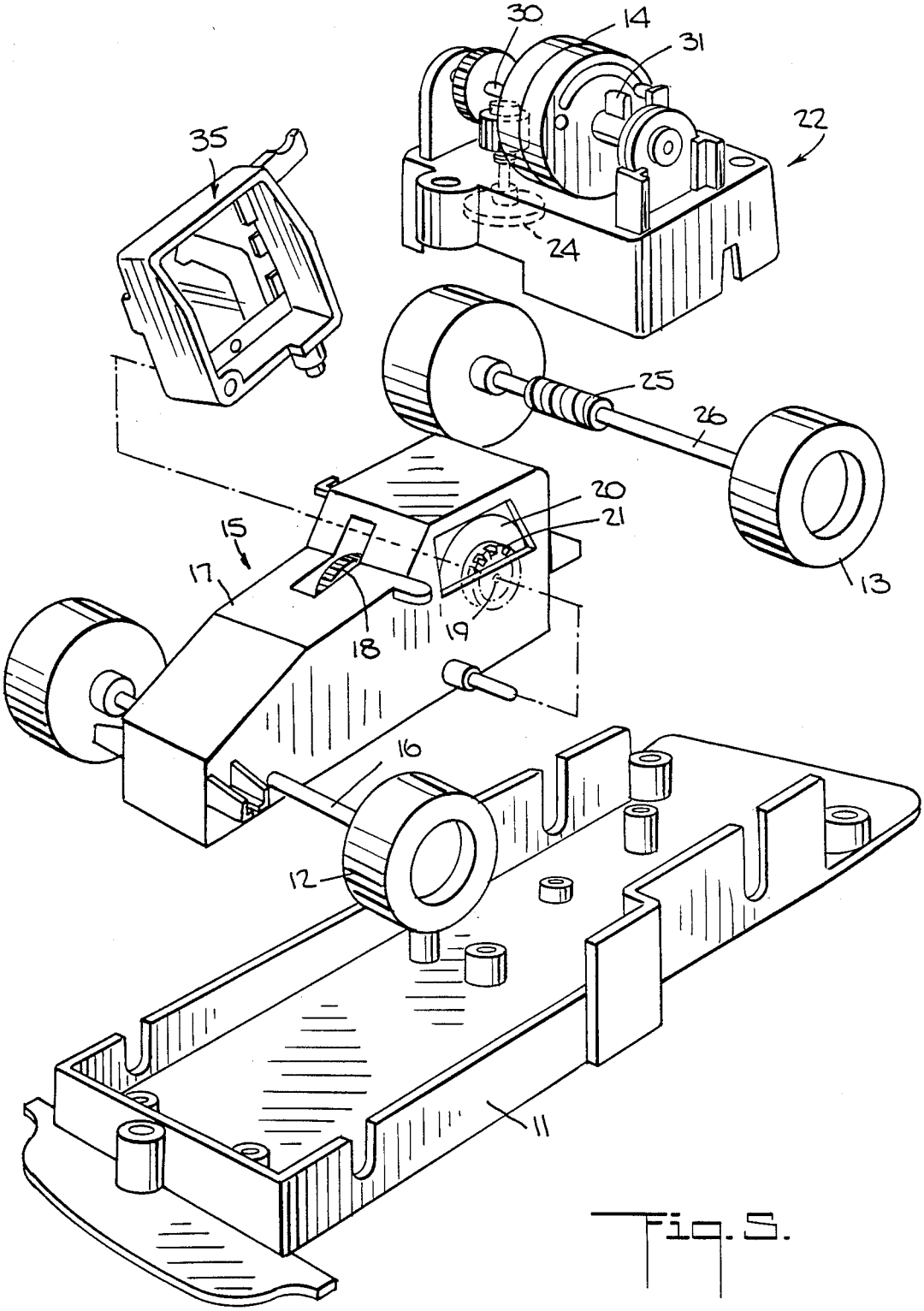
FIG. 5 is an exploded view of the vehicle with its body removed.

The Operating Mechanism:

As shown in FIGS. 3 to 5, mounted on chassis 11 is a flywheel motor assembly, generally designated by numeral 15, operatively coupled to the front wheel axle. Motor assembly 15, which is housed in a casing 17, includes a gear train 18 operatively coupled to the front wheel axle 16 to transmit the rotary motion of this axle to a flywheel 20 mounted on a shaft 19 on which is also mounted a braking wheel 21.

In operation, when the vehicle is pushed forward on the ground by a player, the resultant rotation of the front wheel axle 16 sets flywheel 20 in motion to store energy; and when the vehicle is released, then the rotating flywheel acts as a motor to propel the vehicle in the forward direction until the braking wheel 21 is engaged by a braking clutch 39, in a manner to be later described, at which point motor operation is arrested.

Also mounted on chassis 11 is a settable distance counter assembly, generally designated by numeral 22, this distance being set manually by the drum-shaped dial 14. Dial 14, as best seen in FIG. 4, has a scale of 1 to 10 marked thereon along one side of its circumferential surface adjacent a knurled ring section 23 to facilitate turning of the dial by a finger.

As shown separately in FIGS. 8, 9 and 10, distance counter assembly 22 includes a coupling gear 24 which engages a worm gear 25 keyed to shaft 26 of rear wheel set 13. Coupling gear 24 is mounted on a vertical axle 27 on which is supported a spring-biased pinion 28 that engages a crown gear 29 on the axle 30 on which dial 14 is mounted. The step-down gear ratio of this gear train is such that as rear wheel set 13 travels on the ground a distance of one foot, dial 14 is caused to angularly advance its scale a one foot increment. Also mounted on dial shaft 30 on the opposite side of dial 14 is a pawl 31 (see FIG. 10) which also turns in foot increments.

As shown in FIG. 9, the distance counter assembly is provided with a helical return spring 32, one end of which is linked to an eccentric pin 33 on a wheel 34 mounted on dial shaft 30, the other end being linked to a lug projecting from one side of flywheel motor assembly 15. When the vehicle is advancing along the ground, this causes dial 14 to turn counterclockwise to an extent depending on the distance travelled, and in doing so to stretch and tension spring 32. But when the vehicle is lifted off the ground at the end of play, the spring is then no longer stressed and it acts, in resuming its unstretched state, to turn wheel 33 clockwise and thereby cause dial 24 to return to its zero feet position.

As shown in FIGS. 4 to 7, pivotally mounted on chassis 11 is a braking mechanism, generally designated by numeral 35. The braking mechanism includes square frame 36 from whose lower branch is projected a brake shoe 37 which goes through a hole 41 in chassis 11, the position of the shoe being off-center with respect to the longitudinal central axis of the vehicle.

Figure 6:
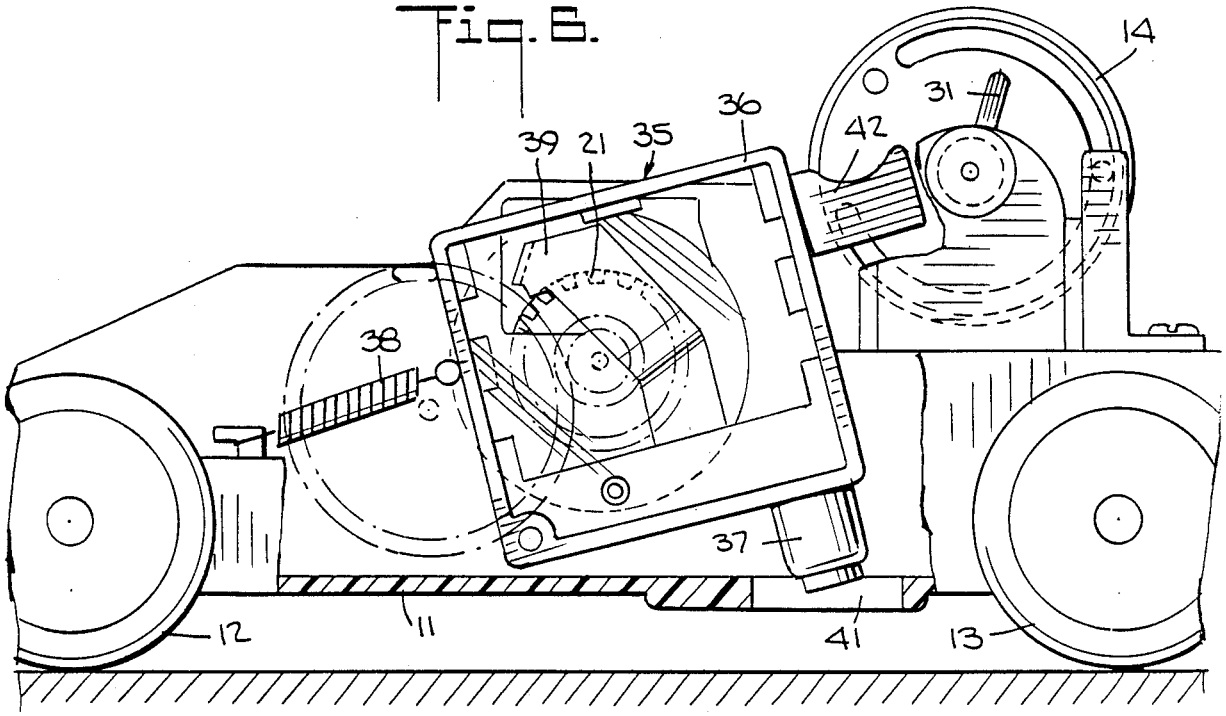
FIG. 6 is a side view of the vehicle with its body removed, showing the braking mechanism in its retracted state.

Pivoted frame 36 is so biased by a spring 38 as to normally retract brake shoe 37 so that it is disengaged from the ground, as shown in FIG. 6. The braking mechanism also includes a brake clutch 39 which is adapted, as shown separately in FIG. 11, to engage braking wheel 21 of the flywheel motor, but is normally disengaged therefrom because of the spring bias on frame 36.

Figure 7:
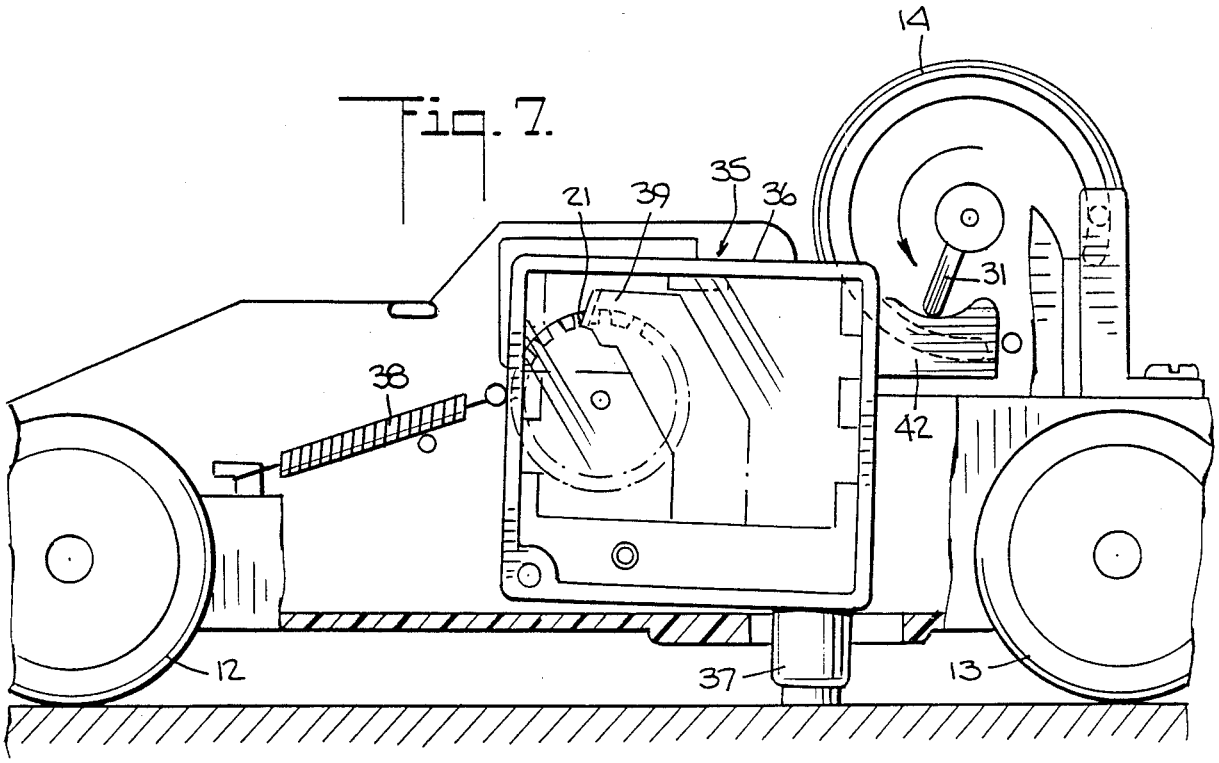
FIG. 7 is the same as FIG. 5 but with the braking mechanism in its operative state.

However, when the vehicle travelling along the ground in the forward direction reaches the distance pre-set by the distance counter dial 14, say, 5 feet of travel, then the dial position and that of pawl 31 thereon is such as to cause pawl 31 to engage a lug 42 projecting from one side of frame 36 of the brake mechanism and to tilt this frame downwardly. When this happens, brake shoe 37, as shown in FIG. 7, is projected to engage the ground, and brake clutch 39 is at the same time caused to engage brake wheel 21 and arrest the flywheel motor.

Because the brake shoe is off center, when it engages the ground, the vehicle is caused to swerve. And because the motor is now arrested, the vehicle, because of its momentum, is caused to skid, these actions resulting in spin-out of the vehicle in the manner previously described.

While there has been shown and described a preferred embodiment of a spin-out toy vehicle in accordance with the invention, it will be appreciated that many changes and modifications may be made therein without, however, departing from the essential spirit thereof.

I claim:

1. A spin-out toy vehicle provided with a chassis supporting a set of front wheels and a set of rear wheels, each set having an axle, said vehicle comprising:

A flywheel motor assembly mounted on the chassis and having a rotatable flywheel with a braking means, said assembly being operatively coupled to one of the axles whereby when the flywheel is revved up and the vehicle is then released, it travels along the ground in the forward direction;

B a settable distance counter assembly means mounted on the chassis and operatively coupled to the other of said axles to establish a distance for travel of the vehicle and to provide an activation when a pre-set distance is travelled; and C a braking mechanism including a normally retracted brake shoe and brake clutch which are activated in response to said activation from said counter assembly means to cause said shoe to project below the chassis to engage the ground at a position at which the shoe is off center with respect to a longitudinal axis of the vehicle and at the same time to cause the brake clutch to engage the braking means to arrest the flywheel whereby said one of the axles is caused to stop rotating and the vehicle is caused to swerve from the forward direction, to skid and to spin out.

2. A vehicle as set forth in claim 1, wherein the motor assembly is coupled to the axle for the front wheel set and the counter assembly is coupled to the axle for the rear wheel set.

3. A vehicle as set forth in claim 1, wherein the motor assembly is provided with a gear train coupling the flywheel to said one of said axles, and said flywheel and said braking means are mounted of a common shaft.

4. A vehicle as set forth in claim 1, wherein said distance counter assembly is provided with a rotatable dial having a distance scale thereon, which dial is coupled by reduction gears to said other of said axes, whereby when said other axle makes a predetermined number of revolutions, the dial is advanced a fraction of a single revolution.

5. A vehicle as set forth in claim 4, wherein said dial is provided with a pawl whose advance as the dial turns provides said indication.

6. A vehicle as set forth in claim 5, wherein said braking mechanism is provided with a lug which is engaged by said pawl to activate the mechanism.

7. A vehicle as set forth in claim 4, wherein said distance counter is provided with a spring coupled to said dial, which spring is subjected to increasing tension as said dial is turned, said spring tension being released when the vehicle is lifted from the ground to reset the dial to its zero distance position.

* * * * *